US005694136A

United States Patent [19]

Westfall

[11] Patent Number: 5,694,136

[45] Date of Patent: Dec. 2, 1997

[54] ANTENNA WITH R-CARD GROUND PLANE

[75] Inventor: Brian G. Westfall, Mountain View, Calif.

[73] Assignee: Trimble Navigation, Sunnyvale, Calif.

[21] Appl. No.: 614,546

[22] Filed: Mar. 13, 1996

[51] Int. Cl.[6] ..... H01Q 1/38

[52] U.S. Cl. ..... 343/700 MS; 343/846; 343/848

[58] Field of Search ..... 343/700 MS, 846, 343/848, 897, 713

[56] References Cited

U.S. PATENT DOCUMENTS

| | | | |
|---|---|---|---|
| 3,587,107 | 6/1971 | Ross | 343/739 |
| 4,151,530 | 4/1979 | Kaloi | 343/700 MS |
| 4,529,987 | 7/1985 | Bhartia et al. | 343/700 MS |
| 4,887,089 | 12/1989 | Shibata et al. | 343/700 MS |
| 4,927,251 | 5/1990 | Schoen | 350/503 |
| 4,965,603 | 10/1990 | Hong et al. | 342/372 |
| 5,061,938 | 10/1991 | Zahn et al. | 343/700 |
| 5,132,623 | 7/1992 | De et al. | 324/338 |
| 5,170,175 | 12/1992 | Kobus et al. | 343/700 MS |
| 5,204,685 | 4/1993 | Franchi et al. | 342/360 |
| 5,248,980 | 9/1993 | Raguenet | 342/354 |
| 5,333,002 | 7/1994 | Gans et al. | 343/700 MS |
| 5,521,606 | 5/1996 | Iijima et al. | 343/846 |
| 5,592,174 | 1/1997 | Nelson | 342/357 |

FOREIGN PATENT DOCUMENTS

| | | | |
|---|---|---|---|
| 3738513 | 6/1989 | Denmark | H01Q 13/00 |
| 4326117 | 2/1995 | Denmark | H01Q 1/22 |
| 318873 | 6/1989 | European Pat. Off. | H01Q 17/00 |
| 394960 | 10/1990 | European Pat. Off. | H01Q 9/04 |
| 2057773 | 4/1981 | United Kingdom | H01Q 1/48 |

OTHER PUBLICATIONS

Synthesis of Tapered Resistive Ground Plane for a Microstrip Antenna, 0-7803-2719-5/95/S4.1995 IEEE, R.G. Rojas et al.

Analysis and Treatment of Edge Effects on the Radiation Pattern of a Microstrip Patch Antenna, 0-7803-2719-5/95/S4.1995 IEEE, Michael F. Otero et al.

*Primary Examiner*—Donald T. Hajec
*Assistant Examiner*—Tan Ho
*Attorney, Agent, or Firm*—Donald S. Dowden

[57] ABSTRACT

An antenna structure has a radiating element and a ground plane. The ground plane has a central region relatively closely spaced apart from the radiating element and a peripheral region extending away from the central region. At least the peripheral region of the ground plane has a sheet resistivity that increases as radial distance from the central region increases. Though physically small, the ground plane simulates an infinite ground plane, and the antenna structure reduces multipath signals caused by reflection from the earth.

31 Claims, 4 Drawing Sheets

ANTENNA WITH R-CARD GROUND PLANE

BACKGROUND OF THE INVENTION

1. Field of the Invention

This invention relates to antenna structures and more particularly to a novel and highly effective antenna structure comprising a radiating element such as a patch antenna in combination with a ground plane constructed to enhance antenna performance.

2. Description of the Prior Art

There is a need for an improved antenna structure for use with a GPS receiver that receives and processes signals from navigation satellites. Antenna structures known heretofore that are capable of optimum performance are too bulky and unwieldy for use in small GPS receivers, especially hand-held receivers. Compact antenna structures that are conventionally employed with GPS receivers do not provide optimum performance. One problem is that they receive signals directly from satellites and, because of ground reflections, also indirectly. This so-called multipath reception causes time measurement errors that can lead to a geographical fix that is erroneous or at least suspect.

A British patent publication No. 2,057,773 of Marconi discloses a large radio transmitting antenna including aerial wires supported in spaced, parallel relation by posts. The ground around the antenna is saturated to a depth of two or three meters with an aqueous solution of calcium sulfate to increase the conductivity of the ground and thereby improve its reflectivity. The ground is permeated to a distance two to three times as far from the antenna as the antenna is tall. In a typical case this can be from 50 to 100 meters from the boundaries of the antenna array.

A European patent publication No. 394,960 of Kokusai Denshin Denwa discloses a microstrip antenna having a radiation conductor and a ground conductor on opposite sides of a dielectric substrate. The spacing between the radiation conductor and the ground conductor, or the thickness of the dielectric substrate, is larger at the peripheral portion of those conductors than at the central portion. Because of the large spacing at the peripheral portion, the impedance at the peripheral portion where electromagnetic waves are radiated is said to be close to the free-space impedance.

A German patent publication No. DE 37 38 513 and its counterpart U.S. Pat. No. 5,061,938 to Zahn et al. disclose a microstrip antenna including an electrically conductive base plate carrying an electrically insulating substrate on top of which are a plurality of radiating patches. A relatively large spacing is established between the electrically insulating substrate and the base plate at lateral dimensions somewhat larger than lateral dimensions of the patches and also in the vicinity of the patches. The patches and spacings are vertically aligned through either local elevations of the insulating substrate or local indentations in the base plate. The feeder line is thus relatively close to the conductive base plate, and the radiating patch is farther away from the conductive base plate. This is said to improve the radiating characteristics of the patch.

A German patent publication No. DE 43 26 117 of Fischer discloses a cordless telephone with an improved antenna.

A European patent publication No. 318,873 of Toppan Printing Co., Ltd., and Seiko Instruments Inc. discloses an electromagnetic-wave-absorbing element comprising an elongate rectangular body of dielectric material having a bottom portion attachable to an inner wall of an electromagnetically dark room, and peripheral elongate faces extending vertically from the bottom portion. A set of the absorbing elements can be arranged in rows and columns on the wall. An electroconductive ink film is formed on the peripheral faces of the body and has a gradually changing surface resistivity decreasing exponentially lengthwise of the peripheral face toward the bottom portion. The incident electromagnetic wave normal to the wall provided with the rows and columns of absorbing elements is absorbed by a lattice of the electroconductive film during the travel along the electroconductive film. In order to avoid reflection of an incident electromagnetic wave at the boundary between the surrounding air and the absorbing element, the characteristic impedance at the top of the element through which the incident wave enters is close to the impedance of air. In order to avoid reflection at the boundary between the bottom of the element and the wall to which it is attached, the characteristic impedance at the bottom is close to that of the wall. The absorbing element is made of a plastic body with an electroconductive covering and having a variable resistivity or conductivity.

The following prior art is also of interest: U.S. Pat. Nos. to Raguenet No. 5,248,980 for Spacecraft Payload Architecture, Franchi et al. No. 5,204,685 for ARC Range Test Facility, De et al. No. 5,132,623 for Method and Apparatus for Broadband Measurement of Dielectric Properties, Hong et al. No. 4,965,603 for Optical Beamforming Network for Controlling an RF Phased Array, and Schoen No. 4,927,251 for Single Pass Phase Conjugate Aberration Correcting Imaging Telescope.

The prior art as exemplified by the patents discussed above does not disclose or suggest an ideal antenna structure for use in a GPS receiver that receives and processes signals from navigation satellites. What is needed in such an environment is an antenna structure that is very light and portable and adapted to hand-held units of the type used, for example, by surveyors.

OBJECTS AND SUMMARY OF THE INVENTION

An object of the invention is to overcome the problems of the prior art noted above and in particular to provide an antenna structure that reduces multipath signals caused by reflection from the earth, that is physically small yet simulates an infinite ground plane, and that is particularly adapted for use in a GPS receiver that receives and processes signals from navigation satellites. Another object of the invention is to provide an antenna structure that is suitable for hand-held units of the type used by surveyors.

In accordance with one aspect of the invention, there is provided an antenna structure comprising a radiating element and a ground plane for the radiating element having a central region relatively closely spaced apart from the radiating element and a peripheral region extending away from the central region, at least the peripheral region of the ground plane having a sheet resistivity that increases as radial distance from the central region increases.

In accordance with an independent aspect of the invention, there is provided a method comprising the steps of forming an antenna structure comprising a radiating element and a ground plane, the ground plane having a central region relatively closely spaced apart from the radiating element and a peripheral region extending away from the central region, at least the peripheral region being formed of a material that has a sheet resistivity that increases as radial distance from the central region increases, and employing the antenna structure to receive electromagnetic signals.

Preferably, an antenna structure in accordance with the invention is characterized by a number of additional features: the radiating element is a patch antenna, the radiating element and the ground plane have the same shape (both square, both circular, both octagonal, etc.), and the radiating element is centered over the ground plane (it is also within the scope of the invention, however, for the radiating element and the ground plane to have dissimilar shapes). Also, at least the peripheral region of the ground plane comprises a nonconductive material—a woven cloth, for example—and a material of variable sheet resistivity supported by the nonconductive material. (The material considered per se may have a uniform linear resistivity and the variation in sheet resistivity may be due to a variation in the thickness of the material, or the material may have a uniform thickness and the variation in sheet resistivity may be due to variation in the linear resistivity of the material, or both the linear resistivity and the thickness of the material may be varied.) The material of variable sheet resistivity can for example have minimum linear resistivity adjacent the central region and maximum linear resistivity at the outer edge of the peripheral region. The ground plane can be planar, frustoconical and concave up or down, or frustopyramidal and concave up or down. The ground plane comprises a conductive portion in the central region, for example a disk made of or coated with aluminum.

The ground plane moreover ideally has a sheet resistivity substantially in the range of 0 to 3 ohms per square measured from dead center to a position adjacent the periphery of the radiating element and a sheet resistivity of substantially 500–800 ohms per square measured from dead center to the periphery of the ground plane. The sheet resistivity of the peripheral region thus exceeds that in the central region by several orders of magnitude, whereby the ground plane, though physically small, simulates an infinite ground plane.

Preferably, in accordance with the method of the invention, the electromagnetic signals are GPS signals broadcast by navigation satellites.

BRIEF DESCRIPTION OF THE DRAWING

A better understanding of the objects, features and advantages of the invention can be gained from a consideration of the following detailed description of the preferred embodiments thereof, wherein like reference characters represent like elements or parts, and wherein.

DESCRIPTION OF THE PREFERRED EMBODIMENTS

Figure 1:
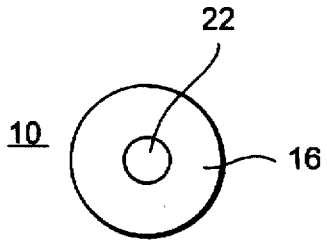
FIG. 1 is a top schematic view of a first embodiment of an antenna structure in accordance with the invention.

FIG 1 is a top schematic view of an antenna 10 constructed in accordance with the invention; FIGS. 2–6 respectively show antenna structures 11–15.

Figure 2:
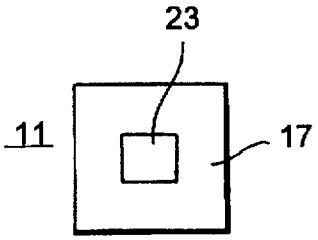
FIG. 2 is a top schematic view of a second embodiment of an antenna structure in accordance with the invention.
Figure 3:
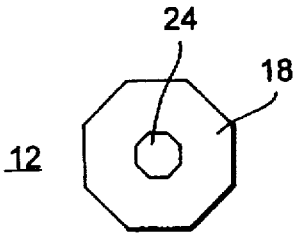
FIG. 3 is a top schematic view of a third embodiment of an antenna structure in accordance with the invention.
Figure 4:
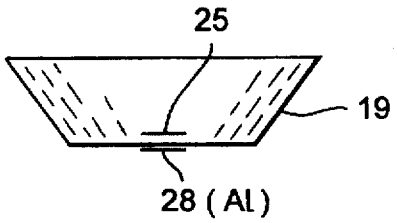
FIGS. 4, 4A, 5, 6 and 6A are side sectional schematic views respectively showing embodiments of concave up (frustoconical), concave up (frustopyramidal), planar, concave down (frustoconical) and concave down (frustopyramidal) ground planes, each of which can have any of the shapes in plan view shown in FIGS. 1–3.
Figure 4A:
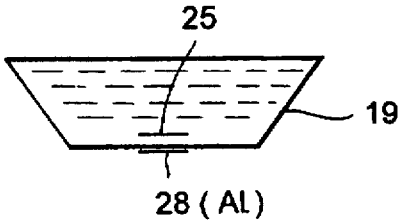
Figure 5:
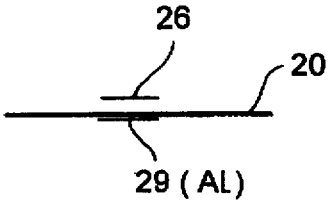
Figure 6:
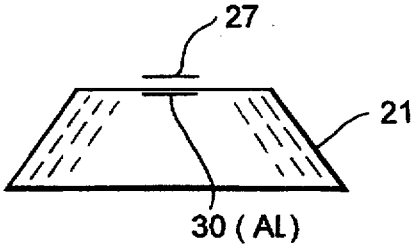
Figure 6A:
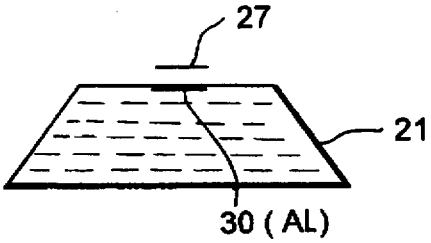

In FIG. 1, the antenna 10 comprises a ground plane 16 and a radiating element 22. Both the ground plane 16 and the radiating element 22 are circular. In FIG. 2 both (17, 23) are square; and in FIG. 3 both (18, 24) are octagonal. In each of FIGS. 1–3 the ground planes 16, 17, 18 are illustrated as planar, but, as FIGS. 4, 4A, 6 and 6A illustrate, they need not be. In FIGS. 4 and 4A the ground plane 19 is concave up and respectively frustoconical and frustopyramidal, and in FIGS. 6 and 6A the ground plane 21 is concave down and respectively frustoconical and frustopyramidal. In FIG. 5 the ground plane 20 is planar. In any of FIGS. 4, 4A, 5, 6 and 6A, the ground plane can have any of the shapes illustrated in FIG. 1–3: circular, square or octagonal. Other shapes both in plan view and in side section are also within the scope of the invention, as those skilled in the art will readily understand.

Figure 7:
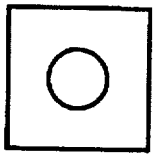
FIGS. 7–10 are top views of respective embodiments of the invention wherein the radiating element and the ground plane have dissimilar shapes.
Figure 8:
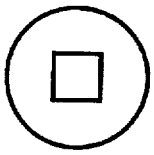
Figure 9:
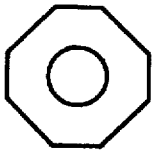
Figure 10:
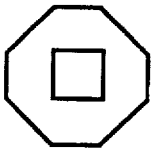

FIGS. 7–10 show embodiments of the invention wherein the radiating element and the ground plane have dissimilar shapes: respectively round/square in FIG. 7, square/round in FIG. 8, round/octagonal in FIG. 9, and square/octagonal in FIG. 10. Other combinations of dissimilar shapes will readily occur to those skilled in the art in light of this disclosure.

While the radiating element used in many applications is preferably a patch, other radiating elements including a quadrifilar helix or four-armed spiral on a cylindrical or conical (or frustoconical) support base are well known in the art and can be used in appropriate cases. In a quadrifilar helix, typically each spiral arm is fed by a power divider with an integral phase shifter to give each arm a successive 90-degree shift (to 0°, 90°, 180°, and 270°).

The special characteristics of the ground plane can be achieved by applying a material of suitable conductivity and varying quantity to a nonconductive material such as a woven cloth. The ground plane is preferably embedded in a dielectric, such as a plastic matrix or carrier 105 (FIG. 12), which also provides insulation for the radiating patch.

At the center of the ground plane there is a conductive portion, which can be formed of a metal such as aluminum or of a nonconductive material such as a woven cloth or a plastic disk impregnated with, or having a coating of, aluminum, another metal, or another conductive material. Aluminum plates 28–30 are illustrated respectively in FIGS. 4–6 (an aluminum plate is of course highly conductive). The aluminum plate has an outer diameter of, say, 5 inches (about 13 cm).

In accordance with the invention, the ground plane of varying sheet resistivity is preferably be made of a special structure called a resistive card (also known as an R-Card) which fits around the conductive plate and has an outer diameter of, say, 13 inches (about 33 cm).

Sheet resistivity is measured in ohms per square. Consider a sheet of homogeneous material of uniform thickness in the shape of a square having a potential applied across it from one edge to the opposite edge. The current that flows is independent of the size of the square. For example, if the size of the square is doubled, the current must flow through double the length of the material, thereby doubling the resistance offered by each longitudinal segment of the square (i.e., each segment extending from the high-potential side of the square to the low-potential side). On the other hand, doubling the size of the square in effect adds a second resistor in parallel to the first and identical to it, thereby reducing the resistance by half. The change in resistance caused by doubling the size of the square is therefore 2×0.5=1. In other words, changing the size of the square does not affect the resistance offered by the square.

In contrast, the sheet resistivity varies in accordance with the present invention. The ground plane in the preferred embodiment of the invention has a sheet resistivity substantially in the range of 0 to 3 ohms per square measured from dead center to a position adjacent the periphery of the radiating element and a resistivity of substantially 500–800 ohms per square measured from dead center to the periphery of the ground plane. The resistivity of the peripheral region thus exceeds that in the central region by several orders of magnitude, whereby the ground plane, through physically small, simulates an infinite ground plane.

The sheet resistivity of free space is 377 ohms per square. The sheet resistivity of the ground plane at the outer periphery is thus much higher than that of free space.

The change in sheet resistivity of the ground plane is not linear as a function of radial distance from the center of the ground plane but varies nonlinearly, preferably in a generally quadratic manner. The variation is preferably continuous but can be in discrete steps, each having a dimension in the radial direction of the ground plane which is small compared to the wavelength of the electromagnetic radiation in the frequency band employed. For example, in the case of an antenna used to receive GPS signals broadcast by navigation satellites, each step can have a radial width of say, ⅛" (about 3 mm). This can be accomplished by varying the thickness of the resistive sheet or by changing its composition. The preferred way is to employ the same conductive material throughout but simply vary the amount used as a function of radial distance. The conductive material can be inexpensively applied to the nonconductive supporting structure, for example a woven cloth, by spraying. Suitable techniques for accomplishing this are known to those skilled in the art.

Figure 11:
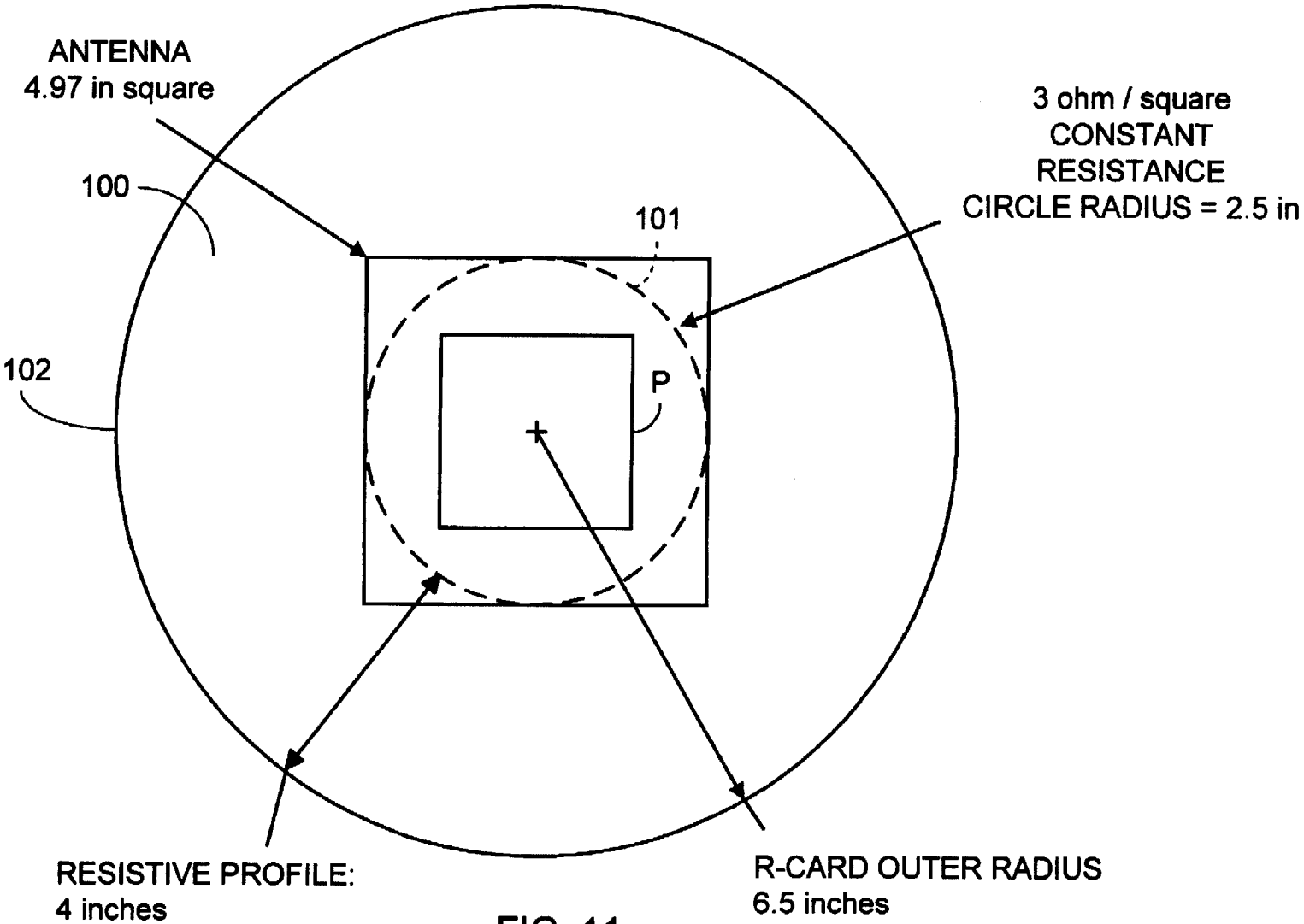
FIG. 11 is a top view showing in more detail a preferred embodiment of an antenna constructed in accordance with the invention.

FIG. 11 shows an R-card having an outer radius of 6.5 inches (about 16.5 cm) and an inner radius of 2.5 inches (about 6.4 cm). It is thus annular with a radial dimension of 4 inches (about 10 cm) between the inner and outer edges 101, 102. The resistivity measured from dead center to the inner edge is 3 ohms per square. The resistivity measured from the inner edge to the outer edge has a resistive profile varying in accordance with the following formula:

$$R=3+4.9881((\exp 1.258x)-1) \quad (1)$$

where R is resistivity in ohms per square and x is distance in inches measured form the inner to the outer edge of the R-card. The graph is plotted in FIG. 14.

The conductive center of the ground plane is 4.97 inches square (about 12.6 cm square) and approximately covers the "hole" in the R-card. From another standpoint, the R-card extends radially out approximately from the edges of the conductive center of the ground plane.

The dimensions of the radiating patch P depend on the dielectric. If air is the dielectric, the patch can be, say, 2 inches (about 5 cm) on a side. If a material of higher dielectric constant is employed, the size of the patch can be reduced to, say, 1.5 inches (about 3.8 cm) on a side.

Figure 12:
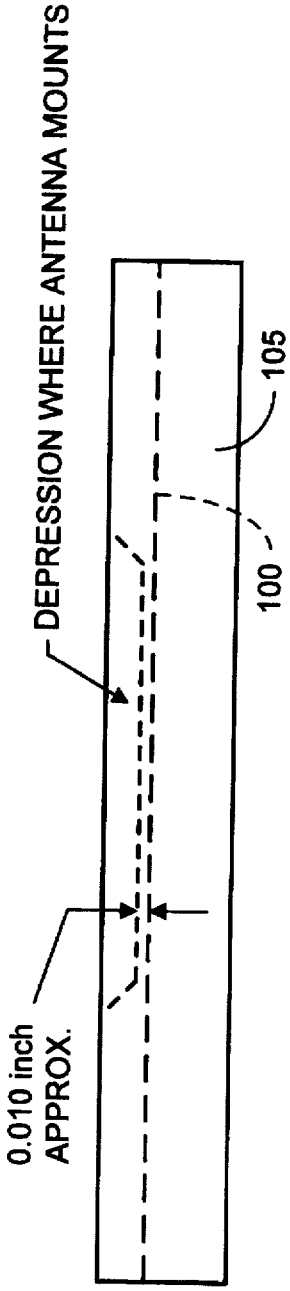
FIG. 12 is an edge view of the antenna of FIG. 11, the vertical dimensions being exaggerated for display purposes.

FIG. 12 is an edge view of an R-card 100 embedded in a plastic carrier or matrix 105. The thickness of the plastic carrier 105 is exaggerated in FIG. 2 for display purposes. The gap between the antenna ground plane and the R-card material is approximately 0.01 inches (about 0.025 cm). A depression is provided where the antenna is mounted. In FIG. 12 the R-card is of uniform thickness and the variation in sheet resistivity depends on a variation in linear resistivity.

Figure 13:
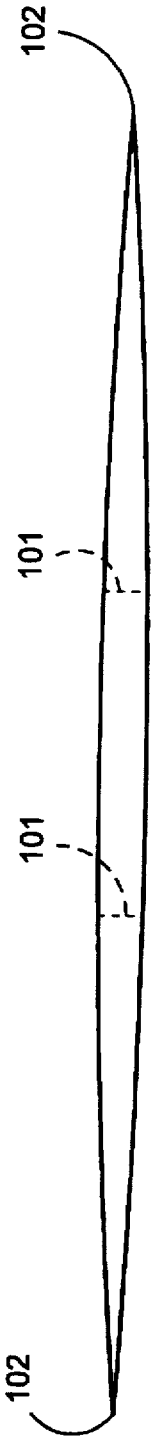
FIG. 13 is a fragmentary edge view showing an alternative form of a portion of the structure of FIG. 12.

FIG. 13 is a fragmentary view of another form of R-card that can be employed in accordance with the invention. In FIG. 13 the linear resistivity can be constant, and the variation in sheet resistivity can be achieved by varying the thickness of the material: it is thickest at the inner edge of the R-card and progressively thinner as a function of increasing radial distance from the inner edge. Of course, any suitable combination of varying linear resistivity and thickness as a function of radial distance from the inner edge of the R-card can in principle be employed in accordance with the invention, as those skilled in the art will readily understand in light of this disclosure.

Figure 14:
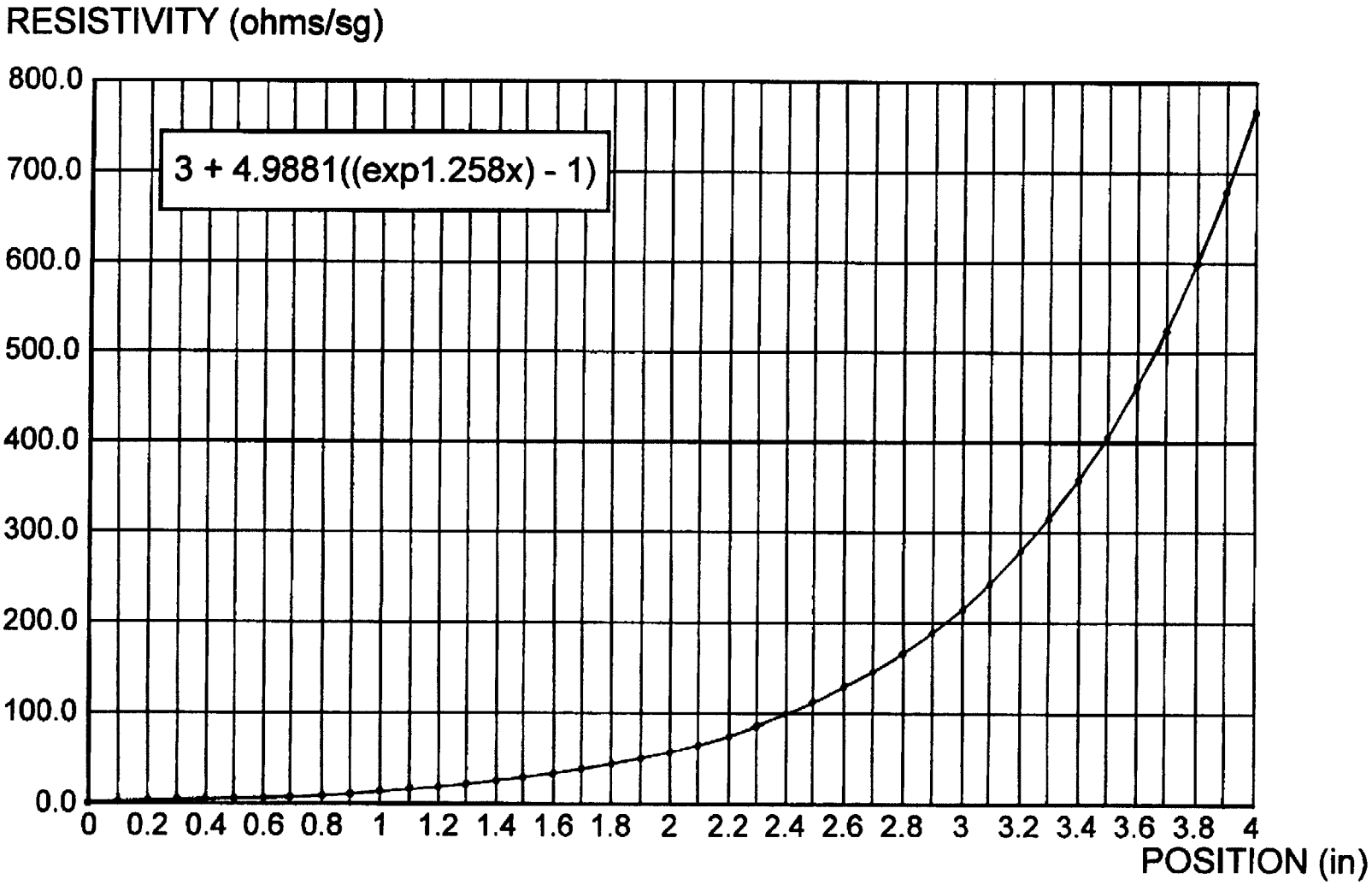
FIG. 14 is a graph showing the resistive profile of a resistive card (R-card) employed in a preferred embodiment of the invention.

FIG. 14 shows the resistivity profile of the R-card for the preferred embodiment of the invention. In equation (1) above, consider for example a position 2.4 inches measured radially from the circle 101 towards the circle 102. The resistivity is calculated from equation (1) as follows:

$$1.258x=3.0192.$$

$$\exp 3.0192=20.475 \text{ (approximately)}$$

$$20.475-1=19.475$$

$$4.9881\times(19.475)=97.143 \text{ (approximately)}.$$

Finally, 3+97.143=100 (approximately), yielding the point (2.4, 100) as illustrated in FIG. 13. A similar calculation produces the other points on the graph.

The antenna structure described above reduces multipath signals caused by reflection from the earth. The ground plane, though physically small, simulates an infinite ground plane because of its varying sheet resistivity. Signals reflected from the ground and impinging on the underside of the antenna structure are absorbed by the ground plane and dissipated as heat; they do not interact substantially with the antenna proper. The antenna is particularly adapted for use in a GPS receiver that receives and processes signals from navigation satellites. Because of its light weight, it is suitable for hand-held units of the type used by surveyors.

While the preferred embodiments of the invention have been described above, many modifications thereof will readily occur to those skilled in the art upon consideration of this disclosure. The invention includes all subject matter that falls within the scope of the appended claims.

I claim:

1. An antenna structure comprising:

a radiating element for receiving broadcast signals directly and, because of reflection of the signals, also indirectly with a time delay, and a ground plane for said radiating element having a central region relatively closely spaced apart from said radiating element and a peripheral region extending away from said central region, at least the peripheral region of said ground plane having a sheet resistivity that increases as radial distance from said central region increases;

whereby the signals received indirectly because of reflection are attenuated.

2. An antenna structure according to claim 1 wherein said sheet resistivity is a continuous function of said radial distance.

3. An antenna structure according to claim 1 wherein said sheet resistivity is a nonlinear function of said radial distance.

4. An antenna structure according to claim 1 wherein said sheet resistivity varies in discrete steps.

5. An antenna structure according to claim 1 wherein said radiating element comprises a patch antenna.

6. An antenna structure according to claim 1 wherein said radiating element and said ground plane have the same shape.

7. An antenna structure according to claim 1 wherein said radiating element and said ground plane are both square.

8. An antenna structure according to claim 1 wherein said radiating element and said ground plane are both circular.

9. An antenna structure according to claim 1 wherein said radiating element and said ground plane are both octagonal.

10. An antenna structure according to claim 1 wherein said radiating element and said ground plane have dissimilar shapes.

11. An antenna structure according to claim 1 wherein said radiating element is circular and said ground plane is square.

12. An antenna structure according to claim 1 wherein said radiating element is square and said ground plane is circular.

13. An antenna structure according to claim 1 wherein said radiating element is circular and said ground plane is octagonal.

14. An antenna structure according to claim 1 wherein said radiating element is square and said ground plane is octagonal.

15. An antenna structure according to claim 1 wherein said radiating element is centered over said ground plane.

16. An antenna structure according to claim 1 wherein said ground plane is planar.

17. An antenna structure according to claim 1 wherein said ground plane is frustoconical and concave up.

18. An antenna structure according to claim 1 wherein said ground plane is frustoconical and concave down.

19. An antenna structure according to claim 1 wherein said ground plane is frustopyramidal and concave up.

20. An antenna structure according to claim 1 wherein said ground plane is frustopyramidal and concave down.

21. An antenna structure according to claim 1 wherein said ground plane comprises a conductive disk in said central region.

22. An antenna structure according to claim 21 wherein said conductive disk is at least in part metallic.

23. An antenna structure according to claim 21 wherein said conductive disk is formed at least in part of aluminum.

24. An antenna structure according to claim 1 wherein said ground plane has a sheet resistivity approaching 3 ohms per square measured from dead center to a position adjacent the periphery of said radiating element and a sheet resistivity much higher than that of free space measured from dead center to the periphery of said ground plane.

25. An antenna structure according to claim 1 wherein the sheet resistivity in said peripheral region exceeds that in said central region by several orders of magnitude, whereby said ground plane simulates an infinite ground plane.

26. An antenna structure comprising:

a radiating element and a ground plane for said radiating element having a central region relatively closely spaced apart from said radiating element and a peripheral region extending away from said central region, at least the peripheral region of said ground plane having a sheet resistivity that increases as radial distance from said central region increases, wherein at least the peripheral region of said ground plane comprises a nonconductive material and a material of varying sheet resistivity supported by said nonconductive material, said material of varying sheet resistivity having maximum thickness adjacent said central region and minimum thickness at the outer edge of said peripheral region.

27. An antenna structure according to claim 26 wherein said nonconductive material comprises a woven cloth.

28. An antenna structure according to claim 26 wherein said nonconductive material comprises a plastic matrix.

29. A method comprising the steps of:

forming an antenna structure comprising:

a radiating element for receiving broadcast signals directly and, because of reflection of the signals, also indirectly with a time delay, and a ground plane, wherein:

the ground plane has a central region relatively closely spaced apart from the radiating element and a peripheral region extending away from the central region, and at least the peripheral region is formed of a material that has a sheet resistivity that increases as radial distance from the central region increases; and employing the antenna structure to receive the broadcast signals;

whereby the signals received indirectly because of reflection are attenuated.

30. A method according to claim 29 wherein the signals are broadcast by navigation satellites.

31. A method according to claim 30 wherein the signals are GPS signals.

* * * * *